US005179740A

United States Patent [19]

Marsilio et al.

[11] Patent Number: 5,179,740

[45] Date of Patent: Jan. 19, 1993

[54] ENCAPSULATED OVERFLOW SYSTEM FOR SINKS AND THE LIKE

[75] Inventors: Ronald M. Marsilio, Mogadore, Ohio; Karl G. Ohaus, Chatham; Drew J. Yuhas, Pennington, both of N.J.

[73] Assignee: American Standard Inc., New York, N.Y.

[21] Appl. No.: 690,246

[22] Filed: Apr. 24, 1991

[51] Int. Cl.[5] ..... E03C 1/24

[52] U.S. Cl. ..... 4/651; 4/680

[58] Field of Search ..... 4/619, 651, 288, 291, 4/292, 680; 138/114, 115

[56] References Cited

U.S. PATENT DOCUMENTS

| | | | |
|---|---|---|---|
| 62,734 | 3/1867 | Craigie | 4/651 |
| 81,225 | 4/1888 | Dunnett | 4/651 X |
| 299,925 | 6/1884 | Harvey | 4/651 X |
| 2,695,411 | 11/1954 | Vinokor | 4/292 |
| 3,110,754 | 11/1963 | Witort et al. | 138/114 X |
| 3,577,572 | 3/1971 | Ruggles et al. | 4/650 X |
| 3,593,347 | 7/1971 | Nemiroff | 4/288 X |
| 4,204.309 | 5/1980 | Lefrancois | 138/115 X |
| 4,209,862 | 7/1980 | Cortes-Garza | 4/651 X |

*Primary Examiner*—Charles E. Phillips
*Attorney, Agent, or Firm*—Blum Kaplan

[57] ABSTRACT

An encapsulated overflow system for use in a sink to interconnect the overflow opening and the drain opening. The system including a tube, an overflow opening adapter and a drain opening adapter. The tube includes an internal supporting rib which prevents collapse of the tube when a layer of plastic material is formed on the underside of the sink.

19 Claims, 3 Drawing Sheets

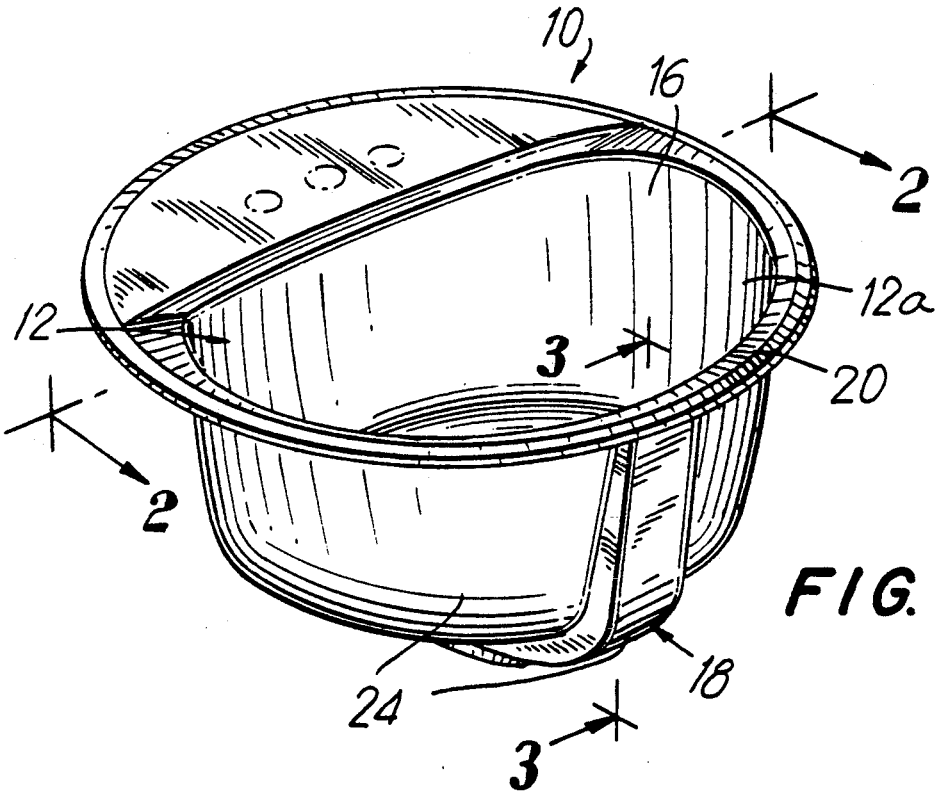
FIG. 1
FIG. 2
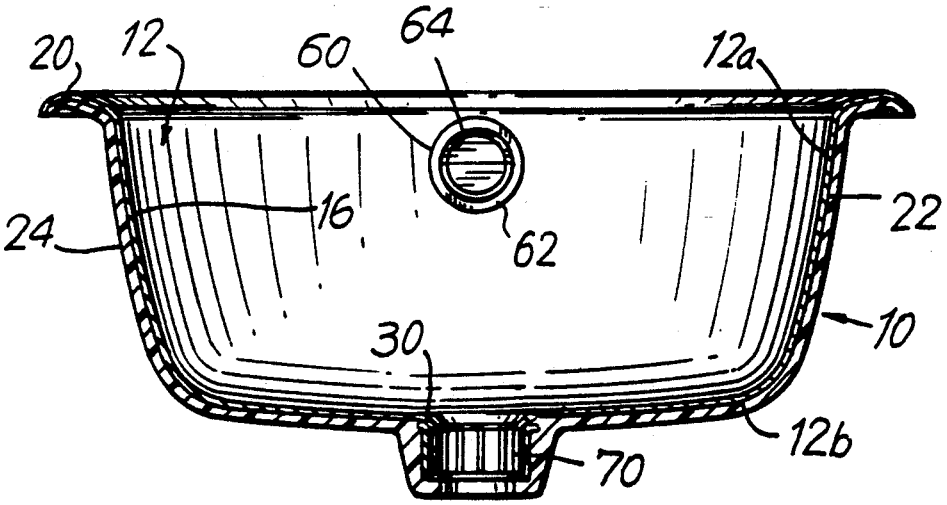

ENCAPSULATED OVERFLOW SYSTEM FOR SINKS AND THE LIKE

BACKGROUND OF THE INVENTION

The present invention is directed to an overflow system for sinks, lavatories or the like which have an overflow opening and, in particular, to an overflow system which interconnects the overflow opening and the drain opening of a sanitary fixture, especially designed and constructed to be encapsulated in a molded plastic material that is bonded to the back surface of the sanitary fixture.

Sanitary fixtures such as sinks, basins, lavatories and the like are generally provided with a drain opening located at the bottom of the bowl and an overflow opening located in a side wall of the bowl proximate the top rim thereof. A conduit or tube is generally provided to interconnect the drain opening and the overflow opening such that when water in the bowl reaches the level of the overflow opening, the water will flow therethrough, into the conduit and into the drain coupled to the drain opening. This prevents water from flowing over the top of the bowl. The overflow assembly is generally formed as an integral passage in china and porcelain fixtures. Alternatively, in enameled steel fixtures, the overflow assembly is separately formed from a steel member and is generally welded to the fixture before the enamelling process takes place.

Recently, it has been proposed to provide a steel or enameled steel fixture having a plastic material bonded to the underside thereof. For example, U.S. Pat. No. 4,664,982 discloses a multi-layer composite structure such as a plastic backed enamel steel sanitary fixture having high impact and thermal shock resistance. The composite structure is formed by bonding a layer of reinforced plastic to the underside of the fixture to form a laminated structure. Thus, a product is produced with a finished layer that is resistant to delamination when subjected to relatively high impact or sudden temperature change applied directly to the finished and/or plastic layer surface.

In the past, when steel sanitary fixtures were formed using a process like that disclosed in U.S. Pat. No. 4,664,982, a one piece overflow assembly was constructed to couple the overflow opening to the drain opening. Such overflow assemblies were constructed of a steel conduit formed to fit the curvature of each particular fixture. A steel conduit was required to withstand the high pressures exerted during molding. The first end of the conduit was configured to cover the overflow opening of the basin and the second end was configured to discharge water in the conduit into the drain. Thus, a special preformed steel overflow channel was required for each differently configured fixture. Furthermore, the metal assemblies were required to be welded to the metal basin prior to the molding process.

It is important in providing an overflow system for a sanitary fixture subjected to a molding process that the components be inexpensive to manufacture while being adapted to withstand the pressures exerted during the molding process. It is also preferable that the drain outlet fitting and overflow outlet fitting be formed separately from the conduit so that these elements of the overflow system may be mass produced to fit several sanitary fixtures, and only a separate conduit need be designed to accommodate significant variations in basin design.

Accordingly, it is desired to provide an encapsulated overflow system which meets the criteria set forth above for operative convenient and inexpensive manufacture thereof.

SUMMARY OF THE INVENTION

Generally speaking, in accordance with the present invention, an encapsulated overflow system for a sanitary fixture such as a sink which directs water from the overflow opening to the drain, is provided. The sanitary fixture includes a basin having a finish side and a non-finish side. A tube interconnects the overflow opening to the drain. The tube includes a support member for preventing collapse of the conduit when the non-finish side of the basin is coated with a layer of plastic material in a mold.

In a preferred embodiment, the overflow system is formed from a thermoplastic material such as polyvinyl chloride (PVC). One of the connectors couples the first end of the tube to the overflow opening of the basin. The other connector couples the second end of the tube to the drain opening. Thus, any water that reaches the level of the overflow opening is directed to the main drain. The support member within the tube prevents the tube from collapsing during the pressure molding of the plastic material on the non-finish side of the sink.

Accordingly, it is an object of the present invention to provide an encapsulated overflow assembly for a sanitary fixture that will not be damaged under the pressure exerted when the underside of the fixture is coated with a plastic material.

Another object of the present invention is to provide a overflow assembly for a sanitary fixture which does not require welding to mount it in fixed position prior to the molding process.

A further object of the present invention is to provide a multi-component, encapsulated overflow assembly that is adapted for use in sanitary fixtures such as sinks and the like.

A still further object of the present invention is to provide an overflow assembly in which the tube connecting the overflow opening to the drain opening is a thermo-plastic tube having at least one integrally formed support member for reinforcing the tube and preventing the tube from collapsing under the heat and pressure generated during the molding process.

Yet another object of the present invention is to provide an overflow system that is easy and inexpensive to manufacture.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a sanitary fixture in the form of a sink which incorporates the encapsulated overflow system constructed in accordance with the present invention;

FIG. 2 is a sectional view taken along line 2—2 of FIG. 1;

DESCRIPTION OF THE PREFERRED EMBODIMENTS

Figure 3:
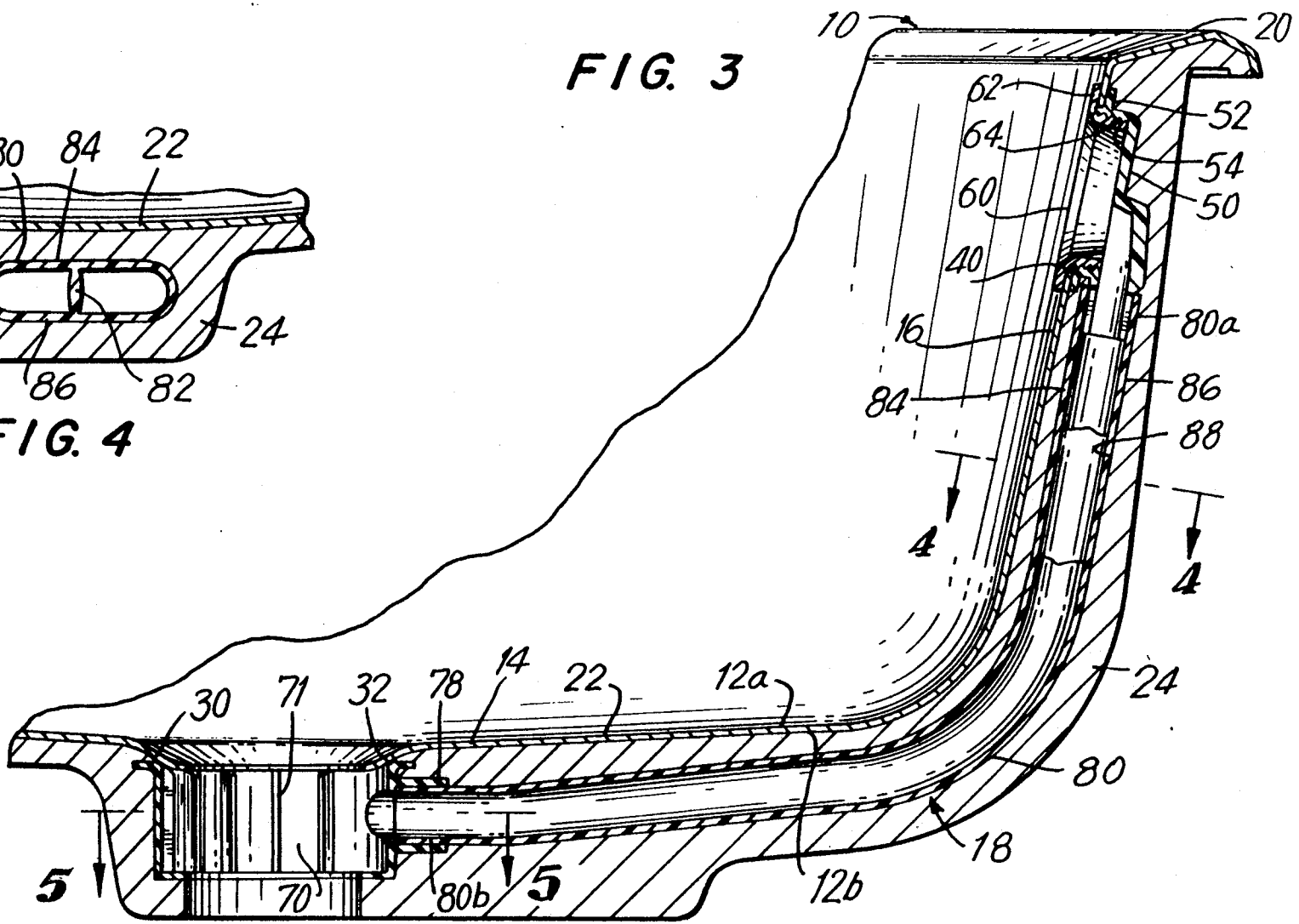
FIG. 3 is a partial enlarged sectional view taken along line 3—3 of FIG. 1.

Reference is first made to FIGS. 1 through 3 which depict a sanitary fixture in the form of a sink, generally indicated at 10, incorporating an encapsulated overflow system, generally indicated at 18, constructed in accordance with a preferred embodiment of the present invention. Sink 10 includes a basin 12 having a finish side 12*a* and a non-finish side 12*b*. Basin 12 has a bottom wall 14 integrally formed with a side wall 16. Side wall 16 of the basin 12 terminates at an upper rim 20 of the basin.

As more fully described in U.S. Pat. No. 4,664,982, the disclosure of which is incorporated by reference herein as though fully set forth, basin 12 is formed of a metal substrate 22 which is formed to the desired shape. Finish side 12*a* of basin 12 may be coated with an enamel layer. Overflow system 18 is supported on exterior non-finish side 12*b* of basin 12. Bottom wall 14 of basin 12 includes a drain opening 30 having a lip 32 which permits waste water to drain therethrough into a main drain coupled to drain opening 30 when sink 10 is installed. Side wall 16 of basin 12 includes an overflow opening 40 proximate rim 20 through which excess water will flow when the water reaches the level of the overflow opening. After overflow assembly 18 is installed on the non-finish side 12*b* of basin 12 as described below in detail, a plastic layer 24 is bonded to non-finish side 12*b* in a mold as described, for example, in U.S. Pat. No. 4,664,982, to cover non-finish side 12*b* and to encapsulate overflow assembly 18 as best shown in FIGS. 1 and 3.

Figure 4:
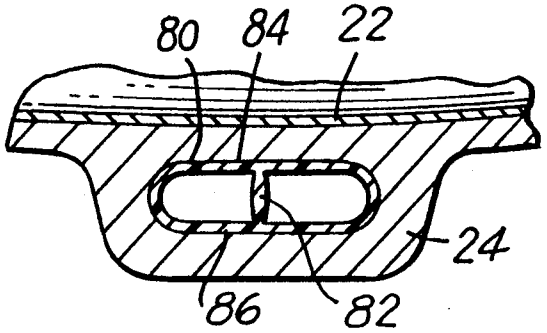
FIG. 4 is a sectional view taken along line 4—4 of FIG. 3.
Figures 5, 6:
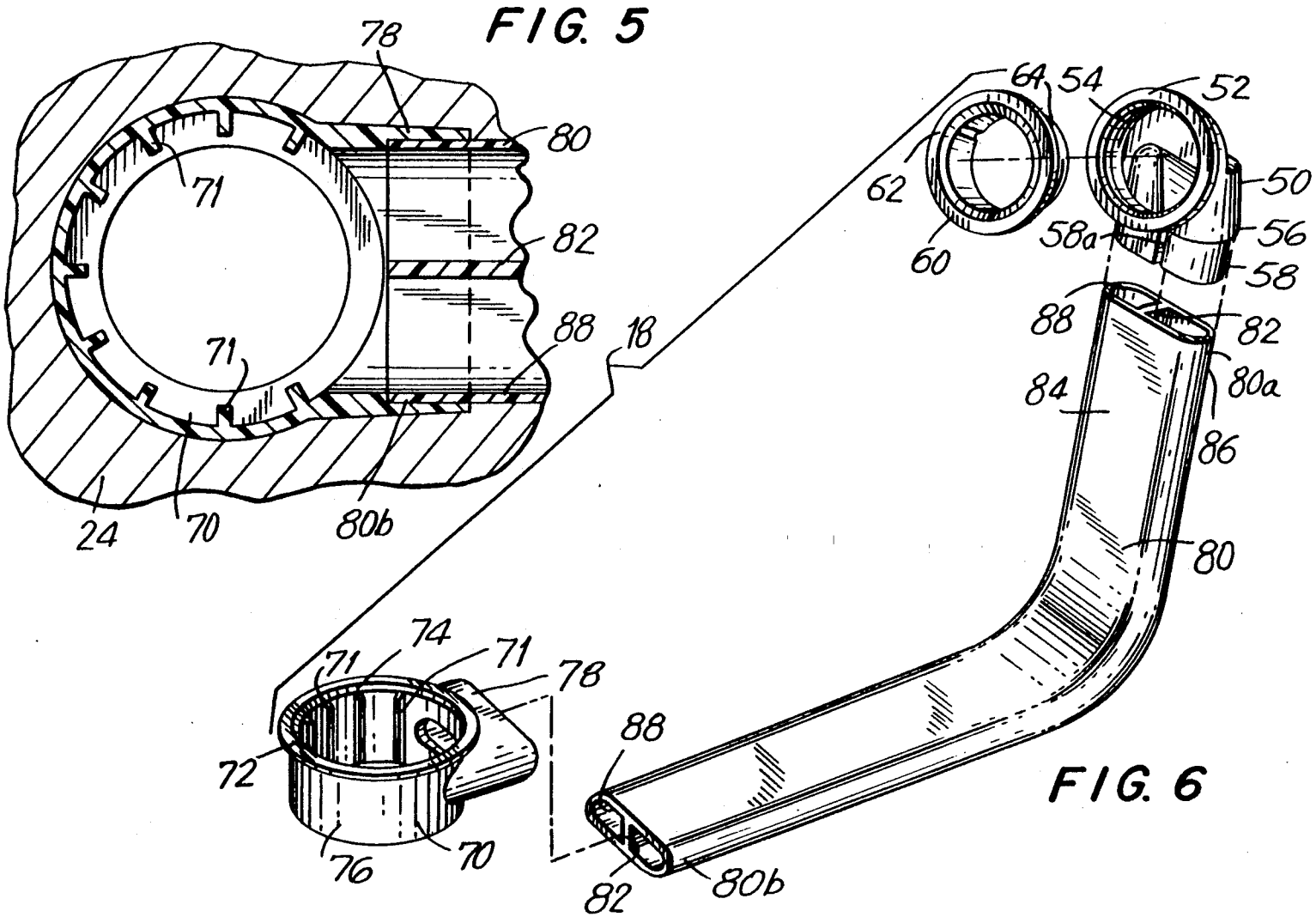
FIG. 5 is an exploded sectional view of a drain outlet taken along line 5—5 of FIG. 3.
FIG. 6 is an exploded perspective view of the components of the overflow system constructed in accordance with the present invention.

Reference is now made additionally to FIGS. 4 through 6 to describe the preferred construction of the encapsulated overflow system of the present invention. Overflow system 18 includes an overflow opening adapter 50, an overflow ring 60, a drain opening adapter 70 and a tube or conduit 80. Overflow ring 60 is preferably formed as a brass ring having a front rim 62 and a threaded portion 64. The other three components of overflow system 18 are preferably formed from PVC or other suitable plastic material.

Overflow opening adapter 50 includes a first annular portion 52 having internal threads 54 sized to receive threads 64 of ring 60, and a second track-shaped portion 56 having a reduced thickness connector 58 which is received in first end 80*a* of tube 80. Overflow opening adapter 50 is hollow to permit water to flow therethrough.

Tube 80 is of an extruded construction, is track-shaped, and may be bent to shape and cut to size for the particular sink for which it will be utilized. Tube 80 includes a reinforcing support in the form of an internal rib 82 which extends centrally lengthwise through tube 80 to support front wall 84 against back wall 86. A through opening 88 separated by rib 82 is provided in conduit 80 to permit water to flow therethrough.

Drain opening adapter 70 is generally annular in shape and includes a first portion 72 defining a rim having a beveled surface 74, a second annular portion 76 which extends downwardly from rim 72, and a third track-shaped collar 78 which extends laterally outwardly from second portion 76. Collar 78 is hollow and opens into second portion 76 of adapter 70. Collar 78 is sized to receive therein second end 80*b* of tube 80. Drain opening adapter 70 also includes a plurality of ribs 71 extending downwardly from beveled surface 74 which gives added support to the adapter to prevent deformation thereof during the encapsulation process.

In the process of installation of overflow system 18 to sink 10, tube 80 is cut and bent to the appropriate size and shape. Reduced thickness connector 58 of overflow adapter 50 is placed within first end 80*a* of tube 80 and solvent welded thereto. In this regard, reduced thickness connector 58 includes opposing cut outs 58*a* to permit rib 82 to extend therein. Second end 80*b* of tube 80 is inserted in collar 78 of drain adapter 70 and solvent welded thereto. Annular portion 54 of overflow adapter 50 is then placed on the non-finish side 12*b* of basin 12 over overflow opening 40 and secured thereto by ring 60 which is inserted through overflow opening 40 and threaded into overflow adapter 50 as best depicted in FIG. 3. Beveled surface 74 of drain adapter 70 is placed against lip 32 forming drain opening 30 and then a hot melt product is applied to provide a seal therearound.

Non finish side 12*b* of basin 12 is then coated with a plastic material in a mold as described, for example, in U.S. Pat. No. 4,664,982 thereby encapsulating overflow system 80 in the plastic material as best depicted in FIG. 3. Internal support rib 82 in tube 80 prevents collapse and/or deformation of tube 80 during the plastic molding application process where pressure during the molding process can be about 35 psi. Likewise, internal ribs 71 in drain adapter 70 prevent deformation thereof. The back of overflow adapter 50 is somewhat curved and somewhat thicker as best depicted in FIG. 3 to prevent deformation thereof during the molding process.

Should water in basin 12 reach the level of the overflow opening, water will flow through ring 60, through overflow adapter 50, through tube 80 and hence into drain adapter 70 which, after installation of the sink, will be coupled to a main drain pipe in a well-known manner.

Thus, the present invention provides an overflow system for a sink which is encapsulated in a plastic material bonded to the under surface of the sink. The overflow system is adapted to withstand the heat and pressure exerted during the molding process when the plastic layer is bonded in place on the non-finish surface of the sink.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An overflow system for a sanitary fixture having a basin, said basin having a finish side and a non-finish side, said non-finish side being coated with a layer of plastic material, said basin further including a drain opening coupleable to a main drain and an overflow opening, comprising a tube formed from a thermoplastic material which tube is bendable along a longitudinal axis and having first and second ends, first coupling means for coupling said first end of said tube to said overflow opening, second coupling means for coupling said second end of said tube to said drain opening, said tube including reinforcing means protruding internally thereof in the form of a rib for preventing internal deformation of said tube when said tube is encapsulated in said layer of plastic material during a molding process.

2. The overflow system as claimed in claim 1, wherein said reinforcing means is an integrally formed rib extending internally along said tube.

3. The overflow system as claimed in claim 2, wherein said rib extends internally throughout the length of said tube.

4. The overflow system as claimed in claim 3, wherein said tube is track-shaped and includes first and second opposing walls, said rib supporting said first wall against said second wall.

5. The overflow system as claimed in claim 1, wherein said first coupling means includes an overflow adapter and a ring for coupling said overflow adapter to said overflow opening.

6. The overflow system as claimed in claim 5, wherein said overflow adapter includes a reduced thickness connector adapted to be received in a first end of said tube.

7. The overflow system as claimed in claim 5, wherein said overflow adapter and ring include mating threads for threading said ring to said overflow adapter through said overflow opening.

8. The overflow system as claimed in claim 5, wherein said ring is constructed of brass.

9. The overflow system as claimed in claim 1, wherein said tube is formed from PVC.

10. The overflow system as claimed in claim 1, wherein said second coupling means includes a drain adapter for coupling a second end of said tube to said drain opening.

11. The overflow system as claimed in claim 10, wherein said drain adapter includes internal ribs.

12. The overflow system as claimed in claim 11, wherein said drain adapter includes a collar, said second end of said tube being inserted in and solvent welded to said collar.

13. The overflow system as claimed in claim 10, wherein said drain adapter includes a collar sized to receive the second end of said tube therein.

14. The overflow system as claimed in claim 10, wherein said first coupling means includes an overflow adapter and a ring for coupling said overflow adapter to said overflow opening.

15. The overflow system as claimed in claim 14, wherein said overflow adapter includes a reduced thickness connector adapted to be received in a first end of said tube.

16. The overflow system as claimed in claim 14, wherein said overflow adapter and ring include mating threads for threading said ring to said overflow adapter through said overflow opening.

17. The overflow system as claimed in claim 14, wherein said tube, overflow adapter and drain adapter are formed from a plastic material.

18. A sanitary fixture for holding water which drains to a main drain, comprising a basin having a drain opening coupleable to the main drain and an overflow opening, said basin having a finish side and a non-finish side, conduit means formed from a thermoplastic material which conduit means is bendable along a longitudinal axis and is coupled intermediate said overflow opening and said drain opening on said non-finish side of said basin for directing water from said overflow opening to said main drain, said conduit means including an internal rib for preventing internal deformation of said conduit means, during the process of encapsulating said conduit means in a plastic layer essentially covering the non-finish side of said basin.

19. The sanitary fixture as claimed in claim 18, wherein said conduit means includes first and second opposing sides, said internal rib supporting said first side against said second side.

* * * * *